US009068412B2

(12) United States Patent
Michaud et al.

(10) Patent No.: US 9,068,412 B2
(45) Date of Patent: Jun. 30, 2015

(54) CONNECTING HEAD FOR CONNECTING A CABLE AND A DOWNHOLE TOOL AND ASSOCIATED INTERVENTION DEVICE

(75) Inventors: Christophe Michaud, Soignolles en Brie (FR); Vincent Chatelet, Le Blanc-Mesnil (FR)

(73) Assignee: GEOSERVICES EQUIPMENTS, Paris Nord II, Roissy en France (FR)

( * ) Notice: Subject to any disclaimer, the term of this patent is extended or adjusted under 35 U.S.C. 154(b) by 411 days.

(21) Appl. No.: 13/517,973

(22) PCT Filed: Dec. 22, 2010

(86) PCT No.: PCT/EP2010/070532

§ 371 (c)(1), (2), (4) Date: Aug. 13, 2012

(87) PCT Pub. No.: WO2011/076868

PCT Pub. Date: Jun. 30, 2011

(65) Prior Publication Data

US 2012/0318494 A1 Dec. 20, 2012

(30) Foreign Application Priority Data

Dec. 22, 2009 (FR) ..... 09 59373

(51) Int. Cl.

| | |
|---|---|
| ***E21B 17/02*** | (2006.01) |
| ***E21B 23/00*** | (2006.01) |
| ***E21B 17/00*** | (2006.01) |
| ***H01B 7/04*** | (2006.01) |
| ***H01R 4/50*** | (2006.01) |
| ***H01R 13/58*** | (2006.01) |
| ***H01R 13/585*** | (2006.01) |
| *H01B 7/22* | (2006.01) |
| *H01R 13/523* | (2006.01) |

(52) U.S. Cl.

CPC ..... *E21B 23/00* (2013.01); *E21B 17/003* (2013.01); *E21B 17/023* (2013.01); *H01B 7/046* (2013.01); *H01B 7/223* (2013.01); *H01R 4/5083* (2013.01); *H01R 13/523* (2013.01); *H01R 13/5833* (2013.01); *H01R 13/585* (2013.01); *H01B 7/22* (2013.01)

(58) Field of Classification Search

USPC ..... 166/385, 65.1, 241.5; 439/730, 878, 439/882, 275

See application file for complete search history.

(56) References Cited

U.S. PATENT DOCUMENTS 3,773,109 A 11/1973 Eberline
4,355,855 A * 10/1982 Rebikoff ..... 439/275

(Continued)

FOREIGN PATENT DOCUMENTS

| | | |
|---|---|---|
| EP | 1403883 | 3/2004 |
| GB | 2263119 | 7/1993 |
| WO | 2006/054092 | 5/2006 |

*Primary Examiner* — Cathleen Hutchins
(74) *Attorney, Agent, or Firm* — Stephanie Chi

(57) ABSTRACT

The head (80) comprises an upper portion for attaching and connecting to a cable (32) and a lower attaching portion for electrically connecting to a control and transmission module (82) of a tool to be lowered in the well. The head (80) comprises a hollow outer enclosure (94) and a mechanical connection assembly. The mechanical connection assembly comprises an attaching member (114) and a liner (116) defining an inner lumen (121) to receive the attaching member (114) and the lower end of the cable (32) The connecting head (80) defines a first downhole electrical path (70) able to extend from a lower segment (126) of the cable to a first connector of the control and transmission module (82), the first downhole electrical path (70) being completely electrically insulated from the outer enclosure (94).

18 Claims, 6 Drawing Sheets

(56) References Cited

U.S. PATENT DOCUMENTS

| | | | | |
|---|---|---|---|---|
| 5,366,018 | A | 11/1994 | Van Steenwyk et al. | |
| 2005/0274514 | A1 | 12/2005 | Tezuka et al. | |
| 2006/0151194 | A1 | 7/2006 | Varkey et al. | |
| 2008/0142244 | A1 | 6/2008 | Head | |
| 2009/0269956 | A1 * | 10/2009 | Frey et al. | 439/275 |

* cited by examiner

CONNECTING HEAD FOR CONNECTING A CABLE AND A DOWNHOLE TOOL AND ASSOCIATED INTERVENTION DEVICE

The present invention concerns a connecting head, comprising:

an upper portion for attaching and connecting to a cable having a smooth outer surface, the cable being able to deploy an intervention and/or measuring tool in a well; and a lower attaching portion for electrically connecting to a control and transmission module of the tool to be lowered in the well, the head comprising a hollow outer enclosure and a mechanical connection assembly received in the hollow outer enclosure, the mechanical connection assembly comprising:

an attaching member;

a liner defining an inner lumen to receive the attaching member and the lower end of the cable, the attaching member being able to grip the cable in the liner.

Such a connecting head is used for securing a tool at the bottom of a cable, in order to lower the tool in a fluid exploitation well bored in the sub-soil.

To perform various complex operations in a well, such as for example opening and closing valves, placing elements such as packings, or perforating a wall, it is known to lower an intervention tool using a stranded electrical cable that makes it possible to transmit electrical power, control information between the surface and the tools situated in the well at the lower end of the cable, and information, for example measurements, from the bottom towards the surface. Such a cable is generally referred to as an "electric line."

These cables are generally formed by a set of electrical conductors surrounded by a strand of metal reinforcing lines making it possible to ensure good mechanical strength of the cable.

Such cables are expensive and their handling at the wellhead, in particular to achieve sealing around the cable, is made complicated by the non-uniform outer surface of the cable.

Moreover, this type of stranded electric line is generally provided with a weak point situated at the connection between the tool and the line to make it possible to recover the line when the tool remains stuck in the bottom of the well. Its tensile strength can therefore be limited.

To offset these problems, known from WO 2006/054092 is a cable having a smooth outer surface, of the "slickline" type, that has, in its structure, a central electric line, surrounded by a polymer sheath reinforced by reinforcing fibers. An electrical conductor is embedded in the sheath.

Such a cable has an outer surface that facilitates sealing at the wellhead, when the cable is introduced into the well.

Such a cable does, however, have a limited strength.

Additionally, such a cable must be connected to the lower tool with a connecting head providing high mechanical resistance to allow various operations to be carried out in the well, in particular jarring or other harsh mechanical operations. Additionally, the connecting head must be able to provide an electrical connection between the downhole assembly and the conductors located in the cable.

One aim of the invention is therefore to provide a connecting head which is suitable for connecting an electric tool with a slickline cable, while maintaining the functionalities of the tool.

To that end, the invention relates to a connecting head of the aforementioned type, characterized in that:

the connecting head defines a first downhole electrical path able to extend from a lower segment of the cable to a first connector of the control and transmission module, the first downhole electrical path being completely electrically insulated from the outer enclosure.

The connecting head according to the invention may comprise one or more of the following feature(s), taken alone or according to all technically possible combination(s):

the mechanical connection assembly comprises an electrically insulating sleeve electrically insulating the attaching member and the liner from the enclosure;

the attaching member is an attaching cone including a wedge, the inner lumen converging upwardly to receive the wedge and the lower end of the cable;

at least one of the liner and of the attaching member is made of a conductive material, in particular of a metal, the first downhole electrical path comprising the liner and/or the attaching member;

the lower attaching portion comprises an electrical downhole connector being part of the first downhole electrical path, at least one of the attaching member and of the liner being electrically connected to the downhole connector;

the upper portion comprises a top insulating sleeve for surrounding the cable and a plurality of sealing rings, for being arranged around the cable, in particular for sealing the hollow outer enclosure;

the enclosure has a pointed upper region and a lower region with a substantially cylindrical section, the upper region and the lower region defining an outer annular groove intended for being grasped by a fishing tool deployed from the surface;

the connecting head comprises an upper electrical connection assembly for connection to a conductive line of the cable, the upper connection assembly comprising at least a ring member having at least a deformable lug stressed towards the axis of the cable, the lug being for application on the conductive line of the cable;

the connecting head comprises a second electrical path, completely insulated from the first electrical path, the second electrical path being for connection to the cable and to a second connector of the control and transmission module, the second electrical path comprising the enclosure; and the ring member is placed in electrical contact with the enclosure to be part of the second electrical path.

The invention also relates to an intervention device in a fluid exploitation well in the subsoil comprising:

an intervention and/or measuring tool intended to be lowered into the well, a cable for deploying the tool in the well, the cable being electrically connected to the tool, the cable having a smooth outer surface and comprising:

a substantially cylindrical central conductor;

an outer sheath applied on the entire periphery of the central conductor, the outer sheath advantageously including a polymer matrix;

a transmission and control module for the tool; and a connecting head as described above, the lower segment of the cable being gripped in the lumen between the attaching member and the liner, at least a conductor of the cable being electrically connected to the first electrical path.

The device according to the invention may comprise one or several of the following features, considered alone or according to all technically possible combinations:

the cable comprises a lower segment in which the outer sheath has been stripped, the lower segment being gripped in the lumen between the attaching member and the liner, the attaching member and/or of the liner being part of the first electrical path;

the lower segment of the cable is folded around the attaching member to be applied on the liner for making a mechanical and electrical connection between a first conductor of the cable and the head;

the head defines a second electrical path completely electrically insulated from the first electrical path, the second electrical path comprising the enclosure, the second electrical path being connected to a second conductor contained in the cable;

the connecting head comprises an upper electrical connection assembly for connection to a conductive line of the cable, the upper connection assembly comprising at least a ring member having at least a deformable lug stressed towards the axis of the cable, the lug being applied on a conductor of the cable, in particular on the second conductor; and the central conductor of the cable comprises a solid metal core having a smooth outer surface, a breaking strength greater than 300 daN and a lineic electrical resistance greater than 30 mohms/m;

the cable includes at least one conductive line extending over substantially the entire length of the cable in the matrix spaced away from the outer surface and spaced away from the central conductor while being electrically insulated from the central conductor, the conductive line being electrically connected to the tool by at least one downhole electrical path;

the tool is electrically connected to the central conductor of the cable by an additional downhole electrical path, electrically insulated from the downhole electrical path;

the outer sheath includes an inner layer of electrically insulating fibers embedded in the polymer matrix, said inner layer being present even the absence of a conductive line in the sheath, the inner layer being inserted between the or each conductive line and the central conductor in the case where the sheath comprises at least one conductive line;

the electrically insulating fibers are formed by silica fibers, advantageously glass fibers;

the central conductor includes a metal outer layer arranged around the cylindrical core, the metal outer layer having a thickness of less than 15% of the thickness of the cylindrical core, the metal outer layer being made with a base of a metal material having an electrical resistance lower than or equal to the electrical resistance of the metal material forming the metal core;

at least one conductive line connected to the intervention tool via the downhole electrical path is formed by a conductor advantageously made of copper, silver, an alloy containing copper, in particular a nickel-copper alloy or an alloy containing silver;

at least one conductive line connected to the intervention tool via the downhole electrical path is formed by a mechanical reinforcing fiber, the mechanical reinforcing fiber having a lineic electrical resistance greater than 3000 mohms/m, advantageously greater than 5000 mohms/m; and the mechanical reinforcing fiber is a carbon fiber.

The invention also relates to an assembly to be used in a fluid exploitation well in the subsoil, of the type comprising:

an intervention device as defined above, intended to be introduced into the exploitation well;

an assembly for deploying the device in the well;

a control unit comprising an electrical source, intended to be placed on the surface outside the well, the electrical source being connected to the cable by at last one surface electrical path.

The assembly according to the invention can comprise one or several of the following features, considered alone or according to all technically possible combinations:

the cable includes at least one conductive line extending over substantially the entire length of the cable in the matrix spaced away from the outer surface and spaced away from the central conductor while being electrically insulated from the central conductor, the conductive line being electrically connected to the tool by at least one downhole electrical path and being connected to the electrical source by the surface electrical path;

the electrical source is connected by an additional surface electrical path to the central conductor, the additional surface electrical path being electrically insulated from the surface electrical path;

the electrical source comprises a surface transmitter and/or receiver to transmit and/or receive an electrical signal conveying information, the tool being connected to a downhole receiver and/or transmitter able to transmit and/or receive an electrical signal conveying information; and the electrical source comprises an electrical power generator able to electrically power, through at least one conductive line, an electrical power receiver arranged in the tool with an electrical power advantageously greater than 1 mW, in particular greater than 1 W.

The invention also concerns a method for operating in a fluid exploitation well in the subsoil, of the type comprising the following steps:

placing an assembly as defined above, the tool being arranged in the well using the cable;

sending an electrical signal transmitting information and/or electrical power advantageously greater than 1 mW, in particular greater than 1 W, from the electrical source towards the tool at least partially through the cable.

The invention will be better understood upon reading the following description, provided solely as an example and done in reference to the appended drawings, in which.

Figure 1:
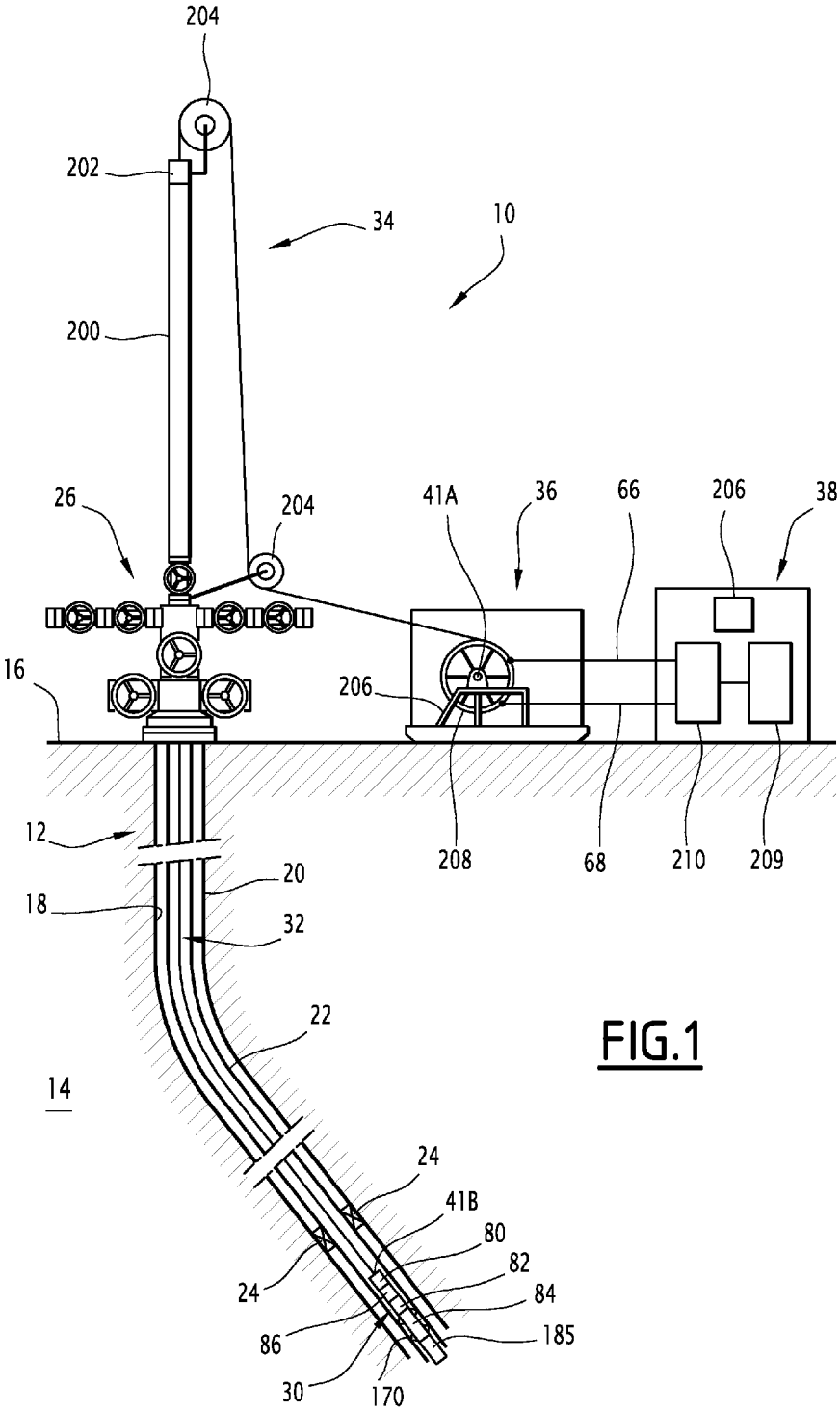
FIG. 1 is a diagrammatic cross-sectional view of a first exemplary assembly for operating in a well according to the invention, the tool being arranged in the bottom of the well at a lower end of the cable.
Figure 2:
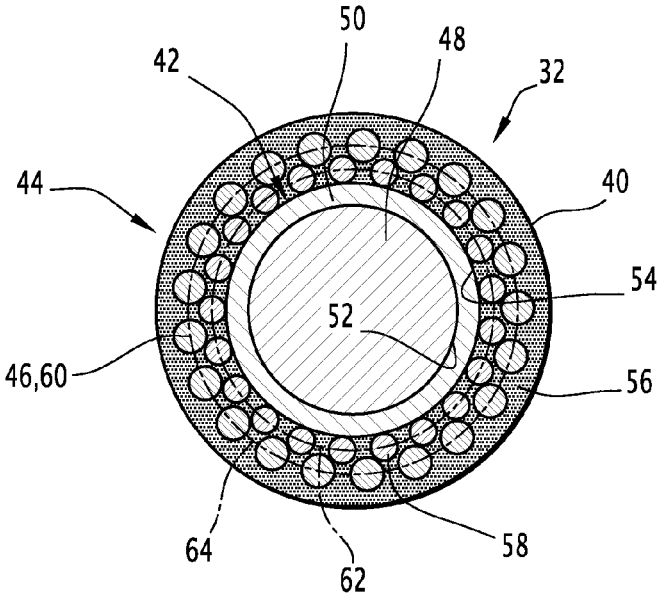
FIG. 2 is a transverse cross-sectional view, illustrating the structure of the cable for transporting the tool in the assembly of FIG. 1.
Figure 3:
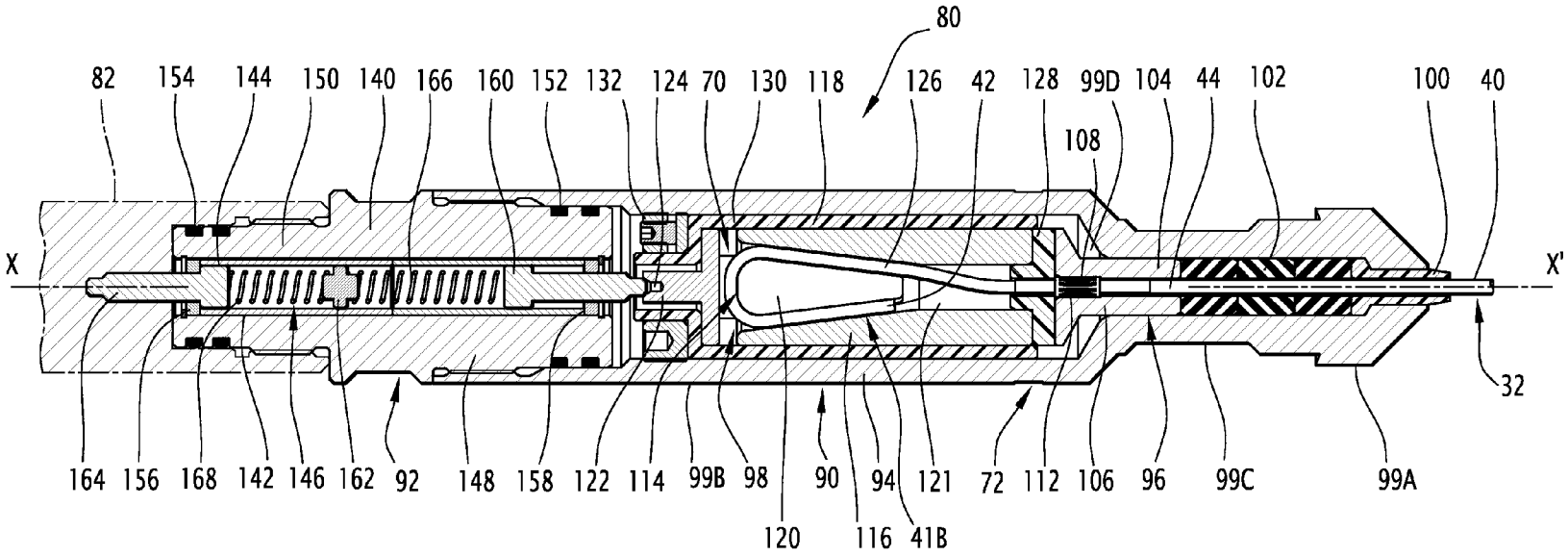
FIG. 3 is a cross-sectional view of a first electrical and mechanical connecting head according to the invention located between the cable and the intervention tool.
Figure 7:
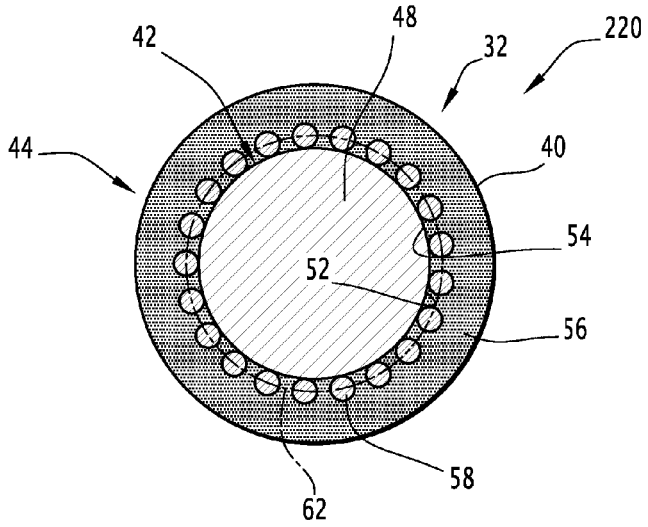
Figure 8:
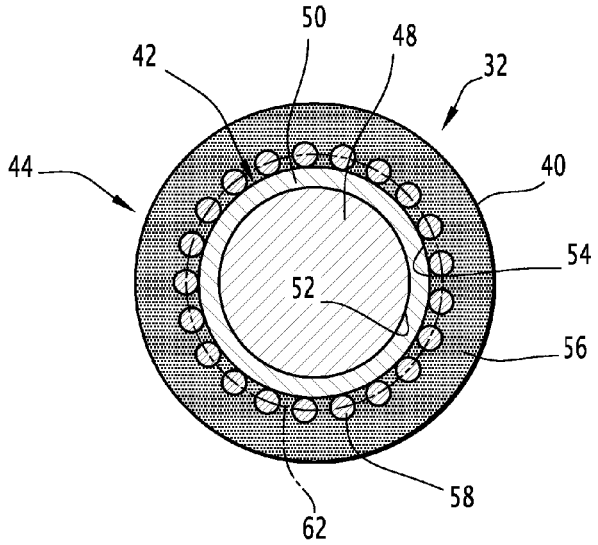
Figure 9:
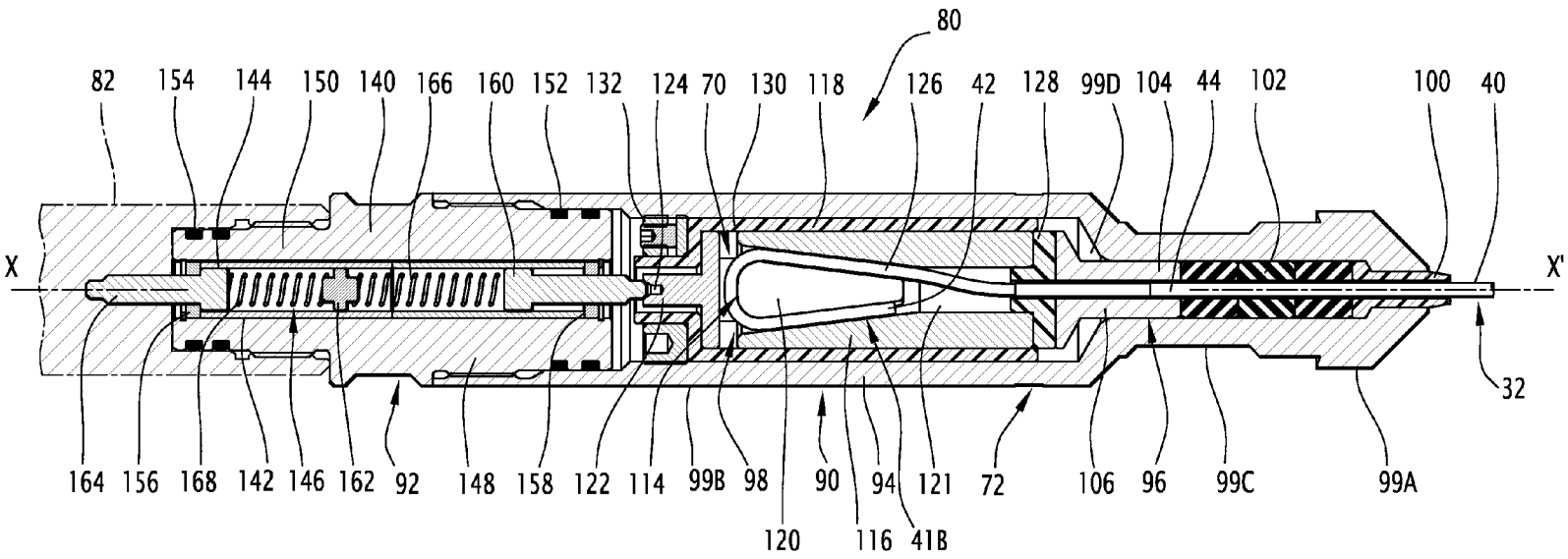

FIG. 7 is a view similar to FIG. 2 of the cable of a fifth assembly according to the invention; and FIG. 8 is a view similar to FIG. 2 of the cable of a sixth assembly according to the invention; and FIG. 9 is a view similar to FIG. 3 of a second electrical and mechanical connecting head according to the invention A first intervention assembly 10 according to the invention is shown in FIGS. 1 to 3.

This assembly 10 is intended to perform operations in a fluid exploitation well 12 in the subsoil 14.

The fluid exploited in the well 12 is for example a hydrocarbon such as oil or natural gas or another effluent, such as vapor or water. Alternatively, the well is an "injector" well in which a liquid or gas is injected.

The intervention assembly 10 is intended to perform operations and/or measurements at any point whatsoever of the well 12 from the surface 16.

The well 12 is formed in a cavity 18 positioned between the surface 16 of the soil and the fluid pool to be exploited (not shown) situated at a given depth in a formation of the subsoil 14.

The well 12 generally includes a tubular outer pipe 20, designated using the term "casing," and for example formed by assembling tubes applied against the formations of the subsoil 14. Advantageously, the well 12 includes at least one inner tubular pipe 22 having a smaller diameter mounted in the outer tubular pipe 20. In certain cases, the well 12 does not have a pipe 22.

The inner tubular pipe 22 is generally called "production tubing." It is advantageously formed by an assembly of metallic tubes made from metal. It is wedged inside the outer tubular pipe 20 for example by packings 24.

The well 12 advantageously includes a wellhead 26 on the surface that selectively closes the outer tubular pipe 20 and the or each inner tubular pipe 22. The wellhead 26 includes a plurality of selective access valves inside the outer tubular conduit 20 and inside the inner tubular conduit 22.

In a variant, in particular during completion, the well 12 is just closed by a drilling Blow Off Preventer (BOP) before the installation of a wellhead 26.

The intervention assembly 10 includes an intervention device formed by an intervention and measuring lower assembly 30 intended to be lowered into the well 12 through the inner tubular pipe 22, and by a cable 32 for deploying the lower assembly 30 in the well 12, the lower assembly being connected to the cable 32 through a connecting head 80, according to the invention which will be described in details later.

The intervention assembly 10 also includes a sealing and alignment assembly 34 of the cable 32, mounted on the wellhead 26, a deployment assembly 36 of the cable 32, arranged near the wellhead 26, and a control unit 38.

In a so-called "open hole" alternative, the assembly 34 is only a cable alignment assembly without sealing means.

As illustrated by FIG. 2, the cable 32 is a solid cylindrical cable having a smooth outer surface 40.

The cable 32 extends between an upper end 41A, fastened on the surface deployment assembly 36, and a lower end 41B, intended to be introduced into the well 12. The lower assembly 30 is suspended at the lower end 41B of the cable 32.

The length of the cable 32, between the ends 41A, 41B is greater than 1000m and is in particular greater than 1000 m and between 1000 m and 10,000 m.

The cable 32 has an outer diameter smaller than 8 mm, advantageously smaller than 6 mm.

The cable 32 has a very high tensile strength and nevertheless surprisingly forms a transmission vector for an electric signal conveying information or electrical power between the intervention lower assembly 30 and the surface control unit 38. The electrical signal is conveyed into the lower assembly 30 through the connecting head 80.

In reference to FIG. 2, the cable 32 comprises a substantially cylindrical central conductor 42 forming a first intermediate electrical path, an outer sheath 44 applied around the central conductor 42 on the entire periphery of the conductor 42, and a plurality of conductive lines 46 electrically insulated from the central conductor 42 to form a second intermediate electrical path electrically insulated from the first intermediate electrical path.

In this example the central conductor 42 includes a cylindrical central core 48, made from a first metal material, and an outer metallization layer 50 made from the first metal material or from a second metal material separate from the first metal material.

The central core 48 is formed by a single strand of solid metal cable, designated by the term "piano wire" and sometimes by the term "slickline cable."

The metal material forming the core 48 is for example a galvanized or stainless steel. This steel for example comprises the following components in weight percentages:

- Carbon: between 0.010% and 0.100%, advantageously equal to 0.050%;
- Chrome: between 10% and 30%, advantageously equal to 15%;
- Manganese: between 0.5% and 6%, in particular between 0.5% and 3%, advantageously equal to 1.50%;
- Molybdenum: 1.5% and 6%, in particular between 1.50% and 4% advantageously equal to 2%;
- Nickel: 5% and 40%, in particular between 5% and 20%; advantageously equal to 10%;
- Phosphorous: less than 0.1%, advantageously less than 0.050%;
- Silicon: less than 1% advantageously less than 0.8%;
- Sulfur: less than 0.05% advantageously less than 0.03%;
- Nitrogen less than 1%, advantageously less than 0.5%.

This steel is for example of the 5R60 type.

The core 48 is solid and homogenous over its entire thickness. It has a smooth outer surface 52 on which the metal outer layer 50 is applied.

The diameter of the core 48 is typically between 1 mm and 5 mm, advantageously between 2 mm and 4 mm, and is for example equal to 3.17 mm, or 0.125 inches.

The core 48 has a breaking strength greater than 300 daN, and in particular between 300 daN and 3000 daN, advantageously between 600 daN and 2000 daN.

The core 48 also has a relatively high lineic electrical resistance, greater than 30 mohms/m, and for example between 50 mohms/m and 150 mohms/m.

The core 48 has a sufficient flexibility to be wound without significant plastic deformation on a drum having a diameter smaller than 0.8 m.

The metal outer layer 50 is made with a base of a metal material having an electrical resistance less than or equal to that of the core 48, for example less than 150 mohms/m, and in particular between 60 mohms/m and 150 mohms/m.

The thickness of the metal layer 50 is for example less than 15% of the diameter of the core 48.

This thickness is for example less than 0.5 mm and in particular less than 0.3 mm.

The outer surface of the metal outer layer 50 is advantageously rough to facilitate adhesion of the outer sheath 44 on the layer 50.

The outer sheath 44 forms an annular sleeve applied on the core 48, over the entire periphery of the core, over substantially the entire length of the cable 32, for example over a length greater than 90% of the length of the cable 32, between its ends 41A, 41B.

The outer sheath 44 thus has a cylindrical inner surface 54 applied against the central conductor 42 and a smooth outer surface defining the smooth outer surface 40 of the cable 32.

The thickness of the sheath 44 is advantageously between 0.2 mm and 2 mm.

As shown in FIG. 2, the outer sheath 44 includes a polymer matrix 56 and mechanical reinforcing fibers 58, 60 embedded in the matrix 56 to reinforce the mechanical properties of the cable 32.

The matrix 56 is made with a base of a polymer such as a fluoropolymer of the fluorinated ethylene propylene (FEP), perfluoroalkoxyalkane, polytetrafluoroethylene (PTFE), perfluoromethyl vinyl ether type, or with a base of polyketone such as polyetheretherketone (PEEK) or polyetherketone (PEK), or with an epoxy base, possibly mixed with a fluoropolymer, or with a base of polyphenylene sulfite polymer (PPS), or mixtures thereof.

Advantageously, the polymer matrix is made from polyetheretherketone (PEEK).

The reinforcing fibers 58, 60 are embedded in the matrix 56, such that the outer surface of each individual fiber 58, 60 or of each group of fibers is substantially completely covered by the polymer forming the matrix 56.

In the example illustrated in FIG. 2, the sheath 44 comprises an inner layer 62 of substantially electrically insulating mechanical reinforcing fibers 58 and an outer layer 64 of relatively conductive mechanical reinforcing fibers 60.

In the example illustrated in FIG. 2, the reinforcing fibers 58 of the first layer 60 are interwoven, for example by braiding, and define intermediate spaces between them filled with polymer. In one alternative, the reinforcing fibers 58 are just wound without interweaving.

The reinforcing fibers 58 are advantageously made with a material having a lineic electrical resistance greater than 10,000 mohms/m.

The reinforcing fibers 58 embedded in the polymer matrix 56 make it possible to achieve a breakdown voltage greater than 2000 V.

Each fiber 58 of the inner layer 62 extends over substantially the entire length of the cable 32, advantageously over more than 90% of the length of the cable 32.

The reinforcing fibers 58 are for example formed with a base of silica fibers, in particular glass fibers with a density of less than 3 with a titer (tex, in grams per km) greater than 30 and for example equal to 33 or advantageously to 66. The diameter of the fibers is in particular less than 0.5 mm, advantageously less than 0.3 mm and is equal to about 0.2 mm.

These fibers 58 have a high tensile strength, and for example have a breaking strength greater than 1,000 MPa.

The inner layer 62 is for example made by at least one bidimensional layer of interwoven fibers 58, advantageously by braiding, or alternatively, wound without interweaving. They have a thickness smaller than 1 mm, advantageously smaller than 0.6 mm and between 0.3 mm and 0.6 mm.

Thus, the inner layer 62 can electrically insulate the central conductor 42 from the conductive lines 46 to avoid any short circuit between the conductor 48 and the lines 46.

Secondarily, the mechanical fibers 58 reinforce the integrity of the polymer matrix 56, for example the electrical insulation of the conductors after shocks.

In the example illustrated in FIG. 2, the reinforcing fibers 60 of the outer layer 64 are arranged outside the inner layer 62. The outer layer 64 has a thickness smaller than 1 mm, advantageously smaller than 0.5 mm, and in particular between 0.3 mm and 0.6 mm.

The outer layer 64 is for example made up of at least one bi-dimensional layer of interwoven fibers 60, advantageously by braiding, or alternatively, wound without interweaving.

Each fiber 60 of the outer layer 64 extends over substantially the entire length of the cable 32, advantageously over more than 90% of the length of the cable 32.

The reinforcing fibers 60 have a density that is advantageously less than 2 with a number of fibers greater than 10,000, advantageously equal to 24,000.

The lineic electrical resistance of the fibers 60 is less than 7,000 mohms/m and for example between 3,000 mohms/m and 7,000 mohms/m.

The tensile strength of the fibers 60 is high such that each fiber 60 has a breaking strength greater than 2500 MPa, preferably between 3000 MPa and 5000 MPa. The reinforcing fibers 60 are advantageously made with a carbon fiber base.

Secondarily, the fibers 60 reinforce the integrity of the polymer matrix 56, for example the electrical insulation of the conductors after shocks.

These reinforcing fibers 60 are for example made from carbon fiber.

In the example illustrated in FIG. 2, the conductive lines 46 are formed by the reinforcing fibers 60 having a relatively high electrical conductivity.

Thus, the central conductor 42 and the conductive lines 46 are electrically insulated from each other over the entire length of the cable to form two parallel intermediate electrical paths through the cable 32 between the surface control unit 38 and the lower assembly 30 connected on the lower end 41B of the cable 32.

The conductive lines 46 thus extend over substantially the entire length of the cable 32, for example over at least 90% of the length of the cable 32.

To that end, the central conductor 42 of the cable 32 is electrically connected to the control unit 38 at the end 41A by a first surface electrical path 66 and the conductive lines 46 are connected to the electrical control unit 38 near the upper end 41A of the cable by a second surface electrical path 68, electrically insulated from the first surface electrical path 66.

Likewise, as will be seen later, the central conductor 42 is electrically connected to the lower assembly 30 by a first downhole electrical path 70, near the lower end 41B and the conductive lines 46 are electrically connected to the lower assembly 30 by a second downhole electrical path 72, at the lower end 41B.

It is thus possible to establish an electrical current loop between the surface unit 38, the first surface electrical path 66, the central conductor 42, the first downhole electrical path 70, the lower assembly 30, the second downhole electrical path 72, the conductive lines 46, and the second surface electrical path 68.

The lower assembly 30 includes an electrical and mechanical connecting head 80 on the cable 32, a control transmission module 82 and at least one downhole tool 84 intended to perform operations and/or measurements at the bottom of the well.

Optionally, the lower assembly 30 also comprises a jar 86 to perform mechanical jarring on the tool 84.

The tool 84 is for example a mechanical actuator able to perform operations at the bottom of a well, such as the opening and closing of the valves, placement of elements, in particular the placement of a packer or another member.

Alternatively, the tool 84 advantageously includes sensors for detecting physical parameters such as the temperature, pressure, flow rate, depth, status of a depth valve, natural radiation of the ground (gamma radiation), location of casing collars (casing collar locator), or other measurement sensors. It can also include exploration devices such as a video camera.

The tool 84 can also include a means for inspecting the tubular pipe 20 or the tubular pipe 22, a tool for cleaning the tubular pipe 22, a tool for cutting the tubular pipe 22, a cutting tool or perforation means, or a centralizer.

The tools 84 are electrically powered by a low electrical power, for example less than 100 W.

In certain cases, the lower assembly 30 can comprise one or several tools 85 that must be powered by a higher electrical power, greater than 300 W, such as a downhole tractor for example.

In the case where an additional tool 85 is mounted under the tool 84, the tool 85 is electrically powered through the tool 84.

In another alternative, the tool 84 also comprises perforation means of the outer tubular pipe 20 and/or of the inner tubular pipe 22 to reach a layer situated in the subsoil 14.

The perforation means in particular include an explosive load and a detonator.

The transmission and control module 82 comprises a downhole transmitter/receiver able to receive an electrical control signal conveyed from the surface 16 control unit 38 through the cable 32 and able to transmit a confirmation or tool status or sensor signal that can be conveyed from the downhole tool 84 towards the surface control unit 38 through the cable 32.

The module 82 also includes a control unit of the tool 84 electrically connected to the tool and to the transmitter/receiver.

The transmitter/receiver is electrically connected to the cable 32 through the connection head 80, as will be seen later.

The downhole transmitter/receiver comprises an electronic circuit and a power source, for example a generator or a battery. It is capable of transmitting and receiving a modulated AC electrical signal with a frequency between 10 Hz and 10 KHz, this signal circulating on the current loop defined above.

The head 80 comprises an upper portion 90 for attaching and connecting the cable 32 and a lower attaching portion 92 for electrically connecting the control and transmission module 82.

The upper portion 90 includes a hollow outer enclosure 94, an upper electrical connection assembly 96 and a lower mechanical and electrical connection assembly 98, the assemblies 96 and 98 being received in the enclosure 94.

The enclosure 94 is made with a base of a conductive metal material.

The enclosure 94 has a pointed upper region 99A and a lower region 99B with a substantially cylindrical section.

The enclosure 94 has a traditional shape to be adapted to "slickline" operations.

The upper region 99A and the lower region 99B thus define an outer annular groove 99C between them for fishing the lower assembly 30 that can be grasped by a fishing tool deployed from the surface.

They inwardly define a through housing 99D extending over the entire length of the enclosure 94.

The upper electrical connection assembly 96 comprises, from top to bottom, an insulating sleeve 100 with a head surrounding the cable 32, a plurality of sealing rings 102 arranged around the cable 32, and an upper jacket 104 for electrical connection to the lines 46.

The upper jacket 104 includes a metal tubular body 106 and a ring 108 for connecting to the conductive lines 46, the ring 108 being arranged in the tubular body 106.

The tubular body 106 is made from an electrically conductive material. It is placed in electrical contact with the enclosure 94. It defines an inner passage 110 for receiving the cable that passes through it longitudinally between its ends.

The connecting ring 108 is arranged in the passage 110. It includes a plurality of deformable lugs 112 stressed towards the axis X-X' of the cable 32.

The lugs 112 are applied on the conductive lines 46 by contact. To that end, the outer sheath 44 is partially stripped until the conductive lines 46 appear.

The lower assembly 98 comprises a attaching cone 114, a conical liner 116 for receiving the cone 114 and the cable 32, and an insulating sleeve 118 electrically insulating the cone 114 and the liner 116 from the enclosure 94 and the upper connection assembly 96.

The cone 114 is made with a base of a metal material.

The cone 114 includes a wedge 120, having a section converging towards the surface, intended to grip the cable 32 in the liner 116, and a lower foot 122 intended to be electrically connected to the lower portion 92 of the head 100. The foot 112 defines a lower orifice 124 for inserting a connection lug.

The liner 116 defines an inner lumen 121 converging upwardly to receive the wedge 120 and the lower end of the cable 32.

A lower segment 126 of the cable 32, in which the sheath 44 has been stripped, is gripped in the lumen 121 between the wedge 120 and the liner 116. This segment 126 is folded in a cross around the wedge 120 to be applied on the liner 116 and on the wedge 120 by making a mechanical and electrical connection of the central conductor 40 of the cable 32 on the head.

The insulating sleeve 118 comprises an intermediate transverse ring 128 inserted between the upper connecting jacket 104 and the liner 116, and a peripheral insulating wall 130 inserted between the liner 116 and the enclosure 94.

A gripping ring 132, screwed into the housing 99D under the lower assembly 98, pushes, from bottom to top, the insulating sleeve 118, the gripping cone 114, the liner 116, the intermediate ring 128, the upper jacket 104 and the sealing rings 102 against the upper insulating sleeve 100 to produce a mechanical stack along the axis X-X'.

The lower portion 92 includes a lower tubular body 140 fastened in the housing 99D of the enclosure 94, the tubular body 140 defining an axial through channel 142. The lower portion 92 also includes a lower insulating sleeve 144 arranged in the channel 142 and a connector 146 inserted into the insulating sleeve 144.

The tubular body 140 comprises an upper region 148 inserted into the enclosure 94 under the lower assembly 98 and a lower region 150 protruding outside the enclosure 94 to be engaged by screwing in the transmission and control module 82.

The body 140 supports upper annular sealing rings 152 intended to achieve sealing with the enclosure 94 and lower annular sealing rings 154 intended to achieve sealing around the module 82.

The through channel 142 extends along the axis X-X' through the body 140. It emerges axially at the ends of the body 140.

The insulating sleeve 144 extends over substantially the entire length of the channel 142. It defines a lower connector stop 156, situated near the lower end of the channel 142, and an upper connector stop 158, arranged near the upper end of the channel 142.

The downhole connector 146 comprises an upper lug 160, a central sliding member 162 and a lower lug 164. It also includes an upper spring 166 inserted between the sliding member 162 and the upper lug 160, and a lower spring 168 inserted between the lower lug 164 and the sliding member 162.

The upper lug 160 can move in translation in the insulating sleeve 144 between a retracted position and a deployed position outside the sleeve 144 partially abutting against the upper stop 158. The lower lug 164 can also move in translation in the insulating sleeve 144 between a partially retracted position, and a position deployed outside the sleeve 144 abutting on the lower stop 156.

The sliding member 162 is mounted free in translation in the insulating sleeve 144. The springs 168, 166 are inserted between the sliding member 162 and the upper lug 160 and lower lug 164, respectively, to stress the lugs 160, 164 towards their deployed positions.

The upper lug 160 is removably received in the orifice 124 formed in the foot 122 of the cone 114 to produce an electrical contact. The lower lug 164 is received in a connector (not shown) arranged in the module 82.

The first downhole electrical path 70 therefore extends from the stripped lower segment 126 of the cable 32, successively through the cone 120, the foot 122, the upper lug 160, the upper spring 166, the sliding member 162, the lower spring 168 to the lower lug 164 connected to a first electrical connector of the module 82.

The second downhole electrical path 72 extends from the lines 46 successively through the electrical connecting ring 108, the jacket 106, the enclosure 94, the lower body 140 and a second electrical connector of the module 82 electrically insulated from the first electrical connector of the module 82.

The first downhole electrical path 70 is completely electrically insulated from the second downhole electrical path.

In the example of FIG. 1, the sealing and alignment assembly 34 comprises a lock chamber 200 mounted on the wellhead 26, a stuffing box 202 to achieve sealing around the cable 32, and return pulleys 204 fastened advantageously on the stuffing box 202 and advantageously on the wellhead 26, respectively, to return the cable 32 back towards the deployment assembly 36.

As indicated above the stuffing box 202 is optional in some cases.

The lock chamber 200 is intended to allow the introduction of the lower assembly 30 in the well 12.

The stuffing box 202 can produce sealing around the smooth outer surface 40 of the cable 32, for example via annular packings applied around said surface 40 and/or by injecting a fluid between the outer surface 40 and the wall of the stuffing box 202.

The steering assembly 36 includes a winch 206 provided with a winder 208. The winch 206 and its winder 208 are placed on the ground or may be placed on board a vehicle (not shown).

The winch 206 can wind or unwind a given length of cable 32 to steer the movement of the lower assembly 30 in the well 12 when it is raised or lowered, respectively.

The upper end 41A of the cable is fastened on the winder 208.

In the example of FIG. 2, the first surface electrical path 66 and the second surface electrical path 68 are electrically connected on one hand, to the central core 48 and the metallization layer 50, and on the other hand, to the conductive lines 46 for example, via rotating collectors, such as brush collectors, respectively.

The unit 38 includes a steering device 206 of the winch, a steering panel 208 for the tool 30, and a surface transmitter/receiver 210 connected to the steering panel 208.

The transmitter/receiver 210 comprises an electronic circuit and an electrical power source, for example a generator or a battery. It can transmit and receive a modulated ac electrical signal bearing information, with a frequency between 10 Hertz and 10 KHz.

The electrical signal is a current injected on the current loop defined above, with an intensity between 0 and 5 amperes, preferably between 0 and 2 amperes, under a voltage between 0 and 2000 volts, for example between 0 and 50 volts.

An example of the operation of the intervention assembly 10 according to the invention will now be described, during an operation in the well.

Initially, the deployment assembly 36 and the control unit 38 are brought to the surface 16 near the wellhead 26. The sealing assembly 34 is mounted on the wellhead 26.

Then, the cable 32 is electrically connected to the control unit 38 via the first surface electrical path 66 and the second surface electrical path 68. The cable 32 is then wound around pulleys 204, then is introduced into the lock chamber 200 through the stuffing box 202.

The lower assembly 30 is then mounted in the lock chamber 200 to be fastened to the lower end 41B of the cable 32.

When the downhole transmitter/receiver is mounted, it is electrically connected to the cable 32 via the first downhole electrical path 70 and the second downhole electrical path 72.

Then, the lock chamber 200 is closed and the sealing is done around the cable 32 at the stuffing box 202. The wellhead 26 is then opened to lower the lower assembly 30 into the well 12 by unwinding an increasing length of cable 32 outside the winder 208.

The lower assembly 30 then lowers into the well to the desired intervention point, which can be located in the inner pipe 22, or beyond the lower end of the inner pipe 22, in the outer pipe 20, or directly in the outer pipe 20 in the absence of inner pipe 22.

During the lowering of the lower assembly 30, the unit 38 advantageously activates measuring sensors present in the lower assembly 30 by transmitting an activation signal through the current loop defined through the cable 32 between the central conductor 42 and the outer conductive lines 46. These sensors for example make it possible to precisely locate the lower assembly in the well.

The signals emitted by the sensors are conveyed to the control and transmission module 82 to be transformed into an electrical measurement signal, which is conveyed through the head 80, the cable 32 and the paths 66, 68 to the unit 38.

When the lower assembly 30 reaches its desired position in the well, the winch 206 is immobilized.

The surface operator then activates the unit 38 to send an intervention control signal to the downhole tool 84. The electrical control signal is emitted by the surface transmitter/receiver 210 and travels along the current loop defined above, to the downhole transmitter/receiver contained in the transmission and control module 86.

The module 82 then activates the tool 84 to perform the operation.

When the operation is finished, the module 82 advantageously emits a confirmation signal via the downhole transmitter/receiver. The confirmation signal is transmitted through the head 80, the cable 32 and the paths 66, 68 to the surface transmitter/receiver in the unit 38 on the current loop defined above.

The cable 32 therefore has all of the advantages of an electric line, since it defines two distinct electrical paths electrically insulated from each other.

It is thus possible to form a current loop as defined above to transmit the information through the cable 32 without having to pass through the casing or through other communication means.

The cable 32 is nevertheless extremely mechanically strong, due to its design. It keeps a smooth outer surface 40 facilitating surface sealing, and has a small diameter.

The cost of the cable 32 and related operations is therefore reduced.

In one alternative, a jar 86 is inserted between the module 82 and the head 80 or between the module 82 and the tool 24.

Given the mechanical strength of the cable 32, it is possible to perform jarring operations using the cable 32 without it being necessary to raise the tool to the surface or have a second, stronger cable.

In one embodiment, the cable 32 comprises a metal central core 48 with a diameter equal to about 3.17 mm (0.125 inches), a metal layer 50 made of aluminum with a thickness substantially equal to 0.1 mm, a polymer matrix 56, for example made from PEEK, with a thickness equal to about 0.9 mm, an inner layer 62 of glass fibers 58 with a thickness equal to 0.4 mm and an outer layer 64 of carbon fibers 60 with a thickness equal to about 0.4 mm.

The length of the cable is then about 7000 m. The resistance of the core 48 is then about 700 ohms, while the resistance of the carbon fibers is about 40,000 ohms.

In one alternative (not shown), the second surface electrical path 68 is electrically connected to the pipe 22, via the wellhead 26. Likewise, the second downhole electrical path 72 is electrically connected to the pipe 22 via centralizers 170 or a tractor or suitable tools.

The current loop is then formed between the surface unit 38, the first surface electrical path 66, the central conductor 42, the first downhole electrical path 70, the lower assembly 30, the second downhole electrical path 72, the pipe 22, the wellhead 26 and the second surface electrical path 68.

In this case, the head 80 does not comprise an electrical connecting ring 108.

In another alternative (not shown), the first surface electrical path 66 and the first downhole electrical path are electrically connected to the conductive lines 46.

The current loop is then formed between the surface unit 38, the first surface electrical path 66, the conductive lines 46, the first downhole electrical path 70, the lower assembly 30, the second downhole electrical path 72, the pipe 22, the wellhead 26 and the second surface electrical path 68.

Figure 4:
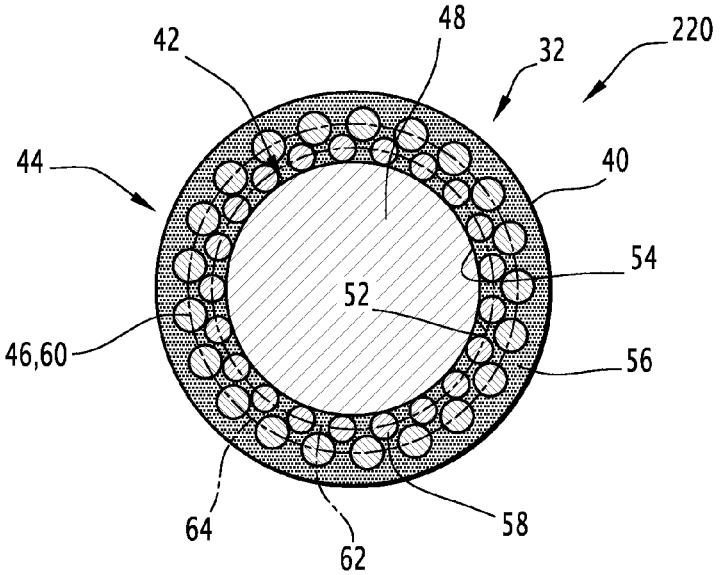
FIG. 4 is a view similar to FIG. 2 of the cable of a second intervention assembly according to the invention.

The cable 32 of a second intervention assembly 220 according to the invention is shown in FIG. 4.

Unlike the cable 32 shown in FIG. 2, the central conductor 42 is formed by the metal cylindrical central core 48. The conductor 42 thus does not have a metal outer layer 50.

The outer sheath 44 is therefore directly applied on the outer surface 52 defined by the core 48.

The volume percentage of reinforcing fibers 58, 60 in the sheath 44 is advantageously greater than 30% and is for example greater than 40% to be equal in particular to about 50%.

The operation of the second intervention assembly 220 according to the invention is also similar to that of the first assembly 10, with a lower production cost.

Figure 5:
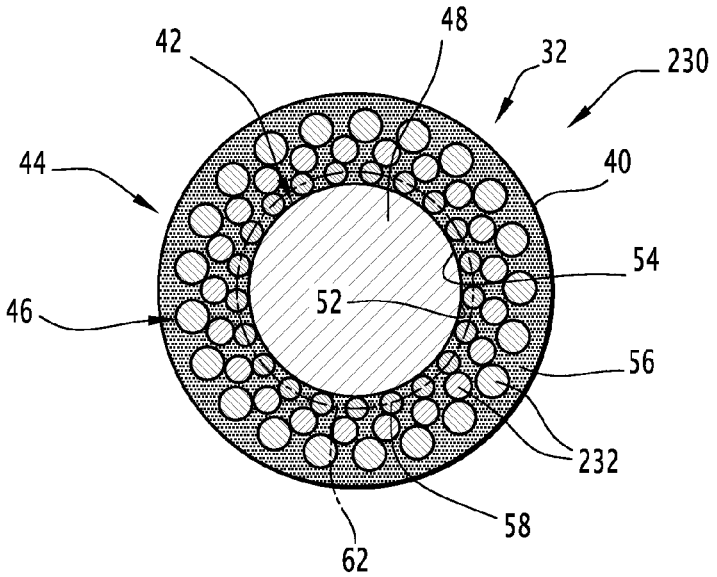
FIG. 5 is a view similar to FIG. 2 of the cable of a third intervention assembly according to the invention.

The cable 32 of a third assembly 230 according to the invention is shown in FIG. 5. Unlike the cable 32 of the first assembly 10, it does not have mechanically reinforcing conductive fibers 20 or the metal layer 50.

This assembly 230 includes conductors 232 forming the conductive lines 46.

The conductors 232 have a base of copper, silver, or an alloy or silver and copper or other conductive materials.

The conductive lines 46 are interwoven, in particular by braiding, or are wound. They have a diameter smaller than 0.5 mm and for example smaller than 0.3 mm, in particular equal to 0.1 mm.

The number of conductive lines 46 is greater than ten, and is advantageously greater than fifty, in particular in the vicinity of a hundred.

The diameter of the conductors 232 is greater than 0.05 mm and is for example substantially equal to 0.1 mm. The number of conductors 232 is greater than 50 and is for example between 50 and 200. The electrical resistance of the conductors 232 is less than 100 mohms/m, advantageously less than 70 mohms/m.

In one advantageous intervention mode, the central conductor 42 is electrically connected to the first surface electrical path 66 and the first downhole electrical path 70, respectively.

The conductors 232 are then connected to the second surface electrical path 68 and the second downhole electrical path 72, respectively.

Alternatively, as described for the assembly 10 of FIG. 2, the conductors 232 are connected to the first downhole electrical path 70 and to the first surface electrical path 66, the current loop then passing through the pipe 22.

In another alternative (not shown), part of the copper conductors 232 make up the first intermediate electrical path through the cable 32, while another part of the copper conductors 232 forms the second intermediate electrical path through the cable 32. The central core 48 is then not connected to the control unit 38. In this case the conductors 232 are insulated from each other so as to avoid any short circuit.

Figure 6:
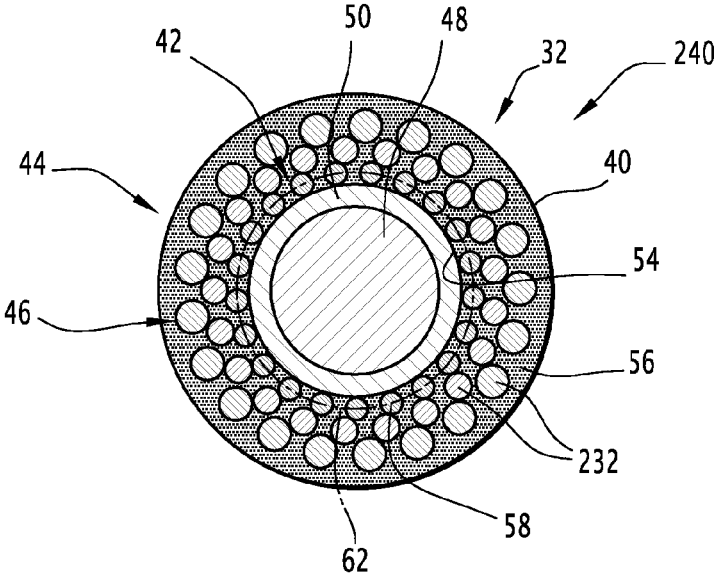
FIG. 6 is a view similar to FIG. 2 of the cable of a fourth assembly according to the invention.

The cable 32 of a fourth assembly 240 according to the invention is illustrated in FIG. 6. Unlike the cable 32 of the third assembly 230, the cable 32 of the fourth assembly 240 includes an outer metal layer 50 arranged on the central core 48 between the central core 48 and the sheath.

The electrical path is the same as previously described in FIG. 5 for the assembly 230.

In this example, the control unit 38 includes an electrical power source able to generate sufficient electrical power to electrically power the downhole tools 84 and 85. Thus, the central conductor 42 is electrically connected to a first terminal of an electrical power receiver of the tool 84, such as an actuator, a measurement sensor or a detonator, and the conductors 232 are connected to a second terminal of the electrical receiver of the tool 84.

The cable 32 then constitutes a link for transmitting electrical power from the electrical power source arranged in the surface unit 38 to the tool 84 situated in the lower assembly.

During specific operations, an electrical voltage for example higher than 100 Volts, in particular higher than 500 Volts, is created by the electrical power source. This electrical voltage is transmitted between the respective terminals of the electrical power source, on the surface, and the respective terminals of the receiver in the downhole tool 84 via the central conductor 42 and the conductive lines 46, respectively.

Under the effect of the control module 86, an electrical power current of the tool 84 can therefore circulate from the electrical power source on a current loop established through the first surface electrical path 66, the central conductor 42, the first downhole electrical path 70, the receiver situated in the downhole tool 84, the second downhole electrical path 72, the lines 46, and the second surface electrical path 68. The created current has an intensity greater than 0.5 amperes and is for example substantially equal to 1 ampere for an electrical power conveyed to the tool 84 equal to about 500 Watts.

The electrical power current can advantageously carry an information transmission signal from the bottom towards the surface or vice versa.

In one embodiment, the electrical cable 32 has a length substantially equal to 7000 meters. The cylindrical central core 48 has a total electrical resistance of about 710 ohms, and the metal layer 50 has a resistance substantially equal to 490 ohms. The equivalent resistance of the central conductor is then 290 ohms.

The total resistance of the copper conductors is 150 ohms, such that the electrical paths defined for the cable 32 have a total resistance between 400 ohms and 450 ohm and advantageously equal to 425 ohms.

In this case, by applying a voltage of 900 volts on the surface, it is possible to obtain an intensity of 1 ampere and to emit and convey an electrical power substantially equal to 500 Watts from the surface unit 38 to the downhole tool 84.

The transmission of electrical power through the cable 32 can also be applied to the other intervention assemblies given as examples.

FIG. 6 illustrates the cable 32 of a fifth intervention assembly 250 according to the invention. Unlike the assembly 220 described in FIG. 4, the assembly 250 has only insulating mechanical reinforcing fibers 58. These mechanical reinforcing fibers 48 are advantageously glass fibers.

In this case, the second surface electrical path 68 is electrically connected to the pipe 22, via the wellhead 26. Likewise, the second downhole electrical path 72 is electrically connected to the pipe 22 via centralizers 170 or a tractor or another suitable tool.

The current loop is then formed between the surface unit 38, the first surface electrical path 66, the central conductor 42, the first downhole electrical path 70, the lower assembly 30, the second downhole electrical path 72, the pipe 22, the wellhead 26 and the second surface electrical path 68.

The cable 32 of a sixth assembly 260 according to the invention is shown in FIG. 8. Unlike the cable 32 shown in FIG. 7, this cable 32 includes a metallization layer 50 as described for the cable 32 of the first assembly 10.

The metal layer 50 is for example made with an aluminum base having a lineic electrical resistance of less than 150 mohms/m and for example between 60 mohms/m and 150 mohms/m.

More generally, in the embodiment of FIG. 9, the cable 32 may comprise only one electrical connection with the control module 82 and with the associated tool 84. The cable 32 may then comprise a single intermediate electrical path between the surface and the connecting head 80.

The single intermediate electrical path is made advantageously of the central conductor 42 or is made of one or of a plurality of conductive lines 46 located in the outer sheath 44.

In that case, the connecting head 80 has an electrical contact with the intermediate electrical path defined in the cable 32 to connect the intermediate electrical path with a connector of the control module 82.

In the embodiment shown in FIG. 9, the sole electrical contact between the cable 32 and the connecting head 80 is located at the attaching cone 114. As described above, the outer sheath 46 of the cable 32 is partially stripped to allow the electrical contact between the sole intermediate electrical path and the first downhole electrical path defined above.

The ring 108 is electrically insulated from the intermediate electrical path defined in the cable 32. In particular, the ring 108 does not comprise a plurality of lugs 112 connecting to the cable 32.

In another embodiment (not shown), the connecting head 80 comprises a connecting ring 108 received in a passage 110 of the tubular body 106. As disclosed in FIG. 3, the connecting ring 108 has at least one deformable lug 112 which constitute the sole electrical contact point between the intermediate electrical path and the connecting head 80.

In this example, the lower end 126 of the cable is not in electrical contact with the attaching cone 114 or with the conical liner 116.

The ring 108 is electrically insulated from the enclosure 94 by insulating means (not shown).

The connecting ring 108 is connected to the downhole connector through the liner 116 which is itself connected to the attaching member.

In that case, the isolating sleeve 118 does not comprise a transverse ring 128 inserted between the upper connecting jacket 104 and the liner 116.

More generally, the connecting head 80 of the present invention can be mechanically connected to any slickline cable comprising at least an internal conductor insulated from the outside by an electrically insulating outer sheath. The electrically insulating outer sheath may be devoid of electrical conductor.

The invention claimed is:

1. A head for connecting a cable to an intervention and/or measuring tool to be lowered in a well, the cable having a smooth outer surface and being able to deploy the tool in the well comprising:

an upper portion for attaching and connecting to the cable; and a lower attaching portion for electrically connecting to a control and transmission module of the tool, the head comprising a hollow outer enclosure and a mechanical connection assembly received in the hollow outer enclosure, the mechanical connection assembly comprising:

an attaching member;

a liner defining an inner lumen to receive the attaching member and the lower end of the cable, the attaching member being able to grip the cable in the liner;

wherein the connecting head defines a first downhole electrical path able to extend from a lower segment of the cable to a first connector of the control and transmission module, the first downhole electrical path being completely electrically insulated from the outer enclosure and wherein the mechanical connection assembly comprises an electrically insulating sleeve electrically insulating the attaching member and the liner from the enclosure.

2. The connecting head according to claim 1, wherein the attaching member is an attaching cone including a wedge, the inner lumen converging upwardly to receive the wedge and the lower end of the cable.

3. The connecting head according to claim 1, wherein at least one of the liner and of the attaching member is made of a conductive material, the first downhole electrical path comprising the liner and/or the attaching member.

4. The connecting head according to claim 3, wherein the conductive material is a metal.

5. The connecting head according to claim 1, wherein the lower attaching portion comprises an electrical downhole connector being part of the first downhole electrical path, at least one of the attaching member and of the liner being electrically connected to the downhole connector.

6. The connecting head according to claim 1, wherein the upper portion comprises a top insulating sleeve for surrounding the cable and a plurality of sealing rings, for being arranged around the cable (32).

7. The connecting head according to claim 6, wherein the top insulating sleeve is for sealing the hollow outer enclosure.

8. The connecting head according to claim 1, wherein the enclosure has a pointed upper region and a lower region with a substantially cylindrical section, the upper region and the lower region defining an outer annular groove intended for being grasped by a fishing tool deployed from the surface.

9. The connecting head according to claim 1, further comprising an upper electrical connection assembly for connection to a conductive line of the cable, the upper connection assembly comprising at least a ring member having at least a deformable lug stressed towards the axis of the cable, the lug being for application on the conductive line of the cable.

10. The connecting head according claim 1, further comprising a second electrical path, completely insulated from the first electrical path, the second electrical path being for connection to the cable and to a second connector of the control and transmission module, the second electrical path comprising the enclosure.

11. The connecting head according to claim 10, further comprising an upper electrical connection assembly for connection to a conductive line of the cable, the upper connection assembly comprising at least a ring member having at least a deformable lug stressed towards the axis of the cable, the lug being for application on the conductive line of the cable, wherein the ring member is placed in electrical contact with the enclosure to be part of the second electrical path.

12. An intervention device in a fluid exploitation well in the subsoil comprising:

an intervention and/or measuring tool intended to be lowered into the well, a cable for deploying the tool in the well, the cable being electrically connected to the tool, the cable having a smooth outer surface and comprising:

a substantially cylindrical central conductor;

an outer sheath applied on the entire periphery of the central conductor, the outer sheath advantageously including a polymer matrix;

a transmission and control module for the tool; and a connecting head comprising:

an upper portion for attaching and connecting to the cable; and a lower attaching portion for electrically connecting to a control and transmission module of the tool, the head comprising a hollow outer enclosure and a mechanical connection assembly received in the hollow outer enclosure, the mechanical connection assembly comprising:

an attaching member;

a liner defining an inner lumen to receive the attaching member and the lower end of the cable, the attaching member being able to grip the cable in the liner;

wherein the connecting head defines a first downhole electrical path able to extend from a lower segment of the cable to a first connector of the control and transmission module, the first downhole electrical path being completely electrically insulated from the outer enclosure wherein the mechanical connection assembly comprises an electrically insulating sleeve electrically insulating the attaching member and the liner from the enclosure, and wherein the lower segment of the cable is gripped in the lumen between the attaching member and the liner, at least the central conductor of the cable being electrically connected to the first electrical path.

13. The device according to claim 12, wherein the cable comprises a lower segment in which the outer sheath has been stripped, the lower segment being gripped in the lumen between the attaching member and the liner, the attaching member and/or of the liner being part of the first electrical path.

14. The device according to claim 12, wherein the lower segment of the cable is folded around the attaching member to be applied on the liner for making a mechanical and electrical connection between a first conductor of the cable and the head.

15. The device according to claim 12, wherein the head defines a second electrical path completely electrically insulated from the first electrical path, the second electrical path comprising the enclosure, the second electrical path being connected to a second conductor contained in the cable.

16. The device according to claim 12 wherein the connecting head comprises an upper electrical connection assembly for connection to a conductive line of the cable, the upper connection assembly comprising at least a ring member having at least a deformable lug stressed towards the axis of the cable, the lug being applied on a conductor of the cable.

17. The device according to claim 16, wherein the lug is applied on the second conductor.

18. The device according to claim 12, wherein the central conductor of the cable comprises a solid metal core having a smooth outer surface, a breaking strength greater than 300 decanewton and a lineic electrical resistance greater than 30 milliohms per meter.

* * * * *